United States Patent [19]

Borowitz

[11] 4,275,434

[45] Jun. 23, 1981

[54] COLLAPSIBLE LAMPSHADE AND RELEASABLE ATTACHMENT MEANS

[75] Inventor: James L. Borowitz, Chicago, Ill.

[73] Assignee: Bradley Manufacturing Company, Chicago, Ill.

[21] Appl. No.: 61,658

[22] Filed: Jul. 30, 1979

Related U.S. Application Data

[63] Continuation-in-part of Ser. No. 935,335, Aug. 21, 1978.

[51] Int. Cl.[3] ..... F21V 1/06

[52] U.S. Cl. ..... 362/352; 362/311; 362/450

[58] Field of Search ..... 362/352, 311, 450

[56] References Cited

U.S. PATENT DOCUMENTS 3,023,307 2/1962 Okamoto ..... 362/352

*Primary Examiner*—Stephen J. Lechert, Jr.

*Attorney, Agent, or Firm*—Mason, Kolehmainen, Rathburn & Wyss

[57] ABSTRACT

A lampshade comprising at least a pair of upper and lower hoops secured to a flexible covering extending between said hoops. The flexible covering is preferably of a washable, stretch knit fabric so that the entire lampshade may be immersed for cleaning. The flexible covering is formed of a flat sheet of a predetermined shape and formed in a tubular configuration by a generally longitudinal seam. A longitudinally extending lighting fixture comprising a plurality of individual light sources is provided for an elongated alternate form of the lampshade. The flexible covering may also be formed of a sheet which is sufficiently pliable to conform to the shape of a single hoop and suffficiently rigid to retain such shape without being weighted or shaped by a second hoop. Manually operable quick release fastening means are provided to interconnect the various coverings to the associated hoop or hoops.

13 Claims, 12 Drawing Figures

COLLAPSIBLE LAMPSHADE AND RELEASABLE ATTACHMENT MEANS

BACKGROUND OF THE INVENTION

Field of the Invention

This application is a continuation in-part of my copending application Ser. No. 935,335 entitled "Collapsible Lampshade" filed Aug. 21, 1978.

This invention relates to common lampshades and more particularly to a flexible, washable lampshade wherein the flexible covering is connected to one or more frame elements by manually operable and releasable fastening means and wherein said covering is slightly resilient or stretchable so that the weight or the inherent stiffness of a portion of the lampshade defines the shape thereof.

BRIEF DESCRIPTION OF THE PRIOR ART

Lampshades are well known articles for use in covering light sources particularly for diffusing emanated light and adding decorative touches to light fixtures. Prior art lampshades generally comprise a hollow structure of translucent material such as paper or the like. The usual lampshades have an upper and lower hoop positioned within the translucent covering to support and give shape to the lampshade. Often, the covering is of heavy, translucent paper stock formed in a frusto-conical configuration with an open top and bottom. The upper and lower edges of the paper stock are secured to the upper and lower hoops which are often additionally secured to one another by a plurality of generally longitudinal ribs. The frusto-conical configuration is often preferred so that the finished lampshades can be nested or stacked for shipping in large quantities from the manufacturer to a distribution chain. Sometimes, prior art lampshades are formed in a fairly cylindrical shape, but in these configurations, they cannot be stacked and thus pose an additional shipping and warehousing problem by their substantial volume. There have also been attempts in the prior art to provide collapsible lampshades, such as that shown in U.S. Pat. Nos. 3,787,676 and 3,557,362. These collapsible lampshades could thus be stored in a minimum of space for warehousing and shipping. Accordingly, the prior art does not provide collapsible lampshades which can be shipped in a high packing density form and require no assembly to provide a finished form. Additionally, none of the prior art lampshades are completely washable and can provide the various shapes and configurations of the lampshade provided by the present invention. The prior art also does not provide a lampshade in which manual quick release means secure the covering to the supporting and shaping hoop or hoops so as to facilitate cleaning or substitution of the covering.

SUMMARY OF THE INVENTION

An object of the present invention is to provide a new and improved collapsible lampshade.

A further object of the present invention is to provide a collapsible lampshade which is completely washable to facilitate cleaning.

A further object of the present invention is to provide a collapsible lampshade in which the shape of the lampshade is defined by the general elasticity of the covering under the influence of the weight of a bottom hoop portion.

A further object of the invention is to provide a collapsible lampshade configurated by the shape and positioning of one or more hoops and the flexibility of the covering.

A further object of the invention is to provide a collapsible lampshade in which manually operable means are provided for ready attachment and detachment of the covering to and from the supporting hoop.

In accordance with the above and other objects, the present collapsible lampshade includes an upper and lower, generally circular hoop to define the upper and lower open ends of the lampshade. A generally flexible elastic-type fabric or covering is secured between the upper and lower hoops to define the lampshade. Preferably, this material is of a stretch knit fabric which is completely washable and all of the hoop and other support elements are covered with a corrosion resistant material, such as nickel plating, to permit total immersion of the lampshade for cleaning. If a permanent attachment between the hoops and the covering is desired a stitched channel enclosing the hoops may be provided in the top and bottom portion of the covering. To permit the utilization of less expensive corrosive hoops, manually operable quick release fastening means as shown in alternative embodiments of the invention may be provided for assembling the covering and the hoops.

In one alternate form, a plurality of hoops are secured in planes generally parallel to the upper and lower hoops at intermediate points along the flexible covering. The covering is cut from conventional sheets of fabric in a shape to fit the particular hoops and, thus, may be flared at the top or bottom or both ends according to the cut of the material. A support means in the form of a plurality of radial spiders mounts the upper hoop to a suitable fixture and the weight of the lower hoops stretches the material to provide the predetermined, smooth exterior contour of the lampshade as the tension throughout the material becomes equalized. In an alternative form, an inner, generally smaller and similar shaped collapsible diffuser facilitates additional diffusion of the light in the event that the exterior covering does not provide enough diffusion.

In another form the invention utilizes covering made of planar-tropic material such as plastic or paper stock sufficiently pliable to bend around a single hoop, in a cylindrical or frusto-conical or other configuration yet sufficiently stiff to retain such configuration in use without the aid of a second hoop.

DETAILED DESCRIPTION OF THE PREFERRED EMBODIMENT

Figure 1:
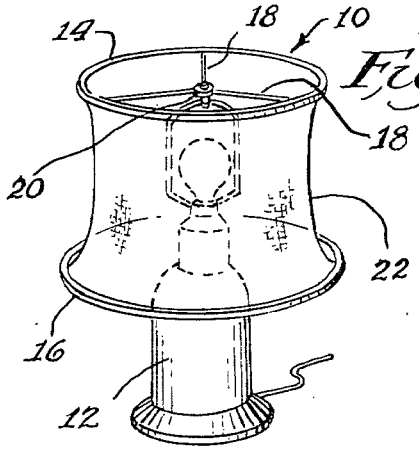
FIG. 1 is a perspective view of a lampshade made in accordance with the concepts of the present invention mounted on a conventional table lamp.

A lampshade, generally designated 10, made in accordance with the concepts of the present invention, is illustrated in FIG. 1 mounted on a table lamp 12 in a conventional manner. The lampshade 10 includes a generally resilient upper hoop 14 and a lower hoop 16. The hoops 14 and 16 are generally circular in shape and may be of different sizes to provide specific lampshade configurations, as described in detail hereinafter. The upper hoop is connected by a plurality of radial arms or spiders 18 to a generally central mounting means in the form of an annular ring 20. On a conventional table lamp such as the lamp 12, the annular ring fits over a threaded upwardly extending stud and is secured thereon by a cap screw or other device which may include various types of ornamentation.

Figure 3:
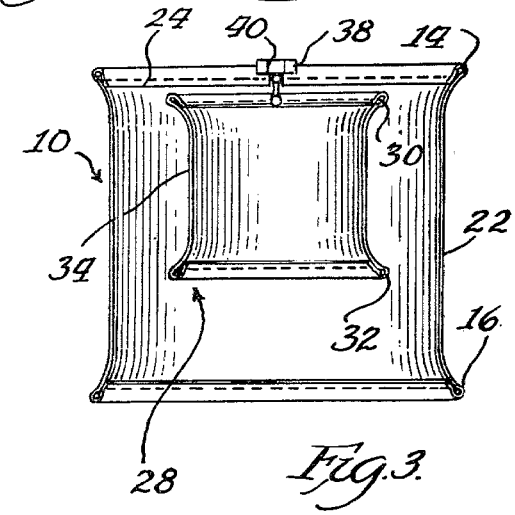
FIG. 3 is a vertical section of the lampshade of the present invention taken generally along line 3—3 of FIG. 2.

The upper and lower hoops 14 and 16 are connected to one another by a flexible covering 22. In the preferred embodiment, the flexible covering is of a stretch knit fabric which is preferably washable to facilitate cleaning of the lampshade. The flexible covering 22 is looped inwardly and over the hoops 14 and 16 as seen in FIG. 3 and then secured as by stitching 24 to permanently secure the hoops 14 and 16 within the looped portion. The hoops 14 and 16 as well as the supporting structure 18 and 20 are covered with a corrosion resistant plating such as nickel to permit the entire lampshade to be immersed in a cleaning fluid to facilitate cleansing of the fabric covering 22. The upper and lower hoops are not connected to one another except by the fabric 22 and thus, the weight of the lower hoop 16 stretches downwardly to provide tensile stresses throughout the fabric covering 22 and thus define the shape of the lampshade.

The fabric covering 22 is typically cut from a bolt of stretch knit fabric material to a desired shape in accordance with the rings or hoops 14 and 16 to be used. For example, if the upper hoop 14 is substantially smaller in diameter than the lower hoop 16 the fabric covering 22 is cut so as to be flared outwardly toward the bottom so that upon seaming to provide a generally tubular shape the lampshade will flare outwardly in accordance with the size of the lower hoop 16 and the shape of the cut material. It can be seen therefore that many various configurations of lampshades can be designed which will provide smooth exterior contours upon the vertical mounting and weight of the lower hoop 16. For example, the lampshade may be frusto-conical, may flare upwardly in a smooth contour at the bottom, may flare outwardly at both the top and the bottom, or take many other desired shapes. Because of the flexible fabric nature of the covering 22, the lampshades are easily collapsed and can be stored in a box having a thickness slightly greater than that of the diameter of the wire forming the hoops 14 and 16. The particular use of a stretch knit material for the covering 22 is extremely advantageous in the present invention since the elasticity and stretchability of the fabric itself serve to provide a smooth exterior contour to the finished lampshade as well as substantially disguising any otherwise noticeable inaccuracies in stitching.

Figure 2:
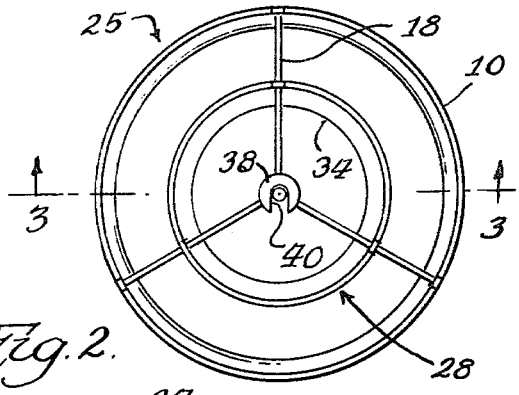
FIG. 2 is a top plan view of a lampshade and diffuser combination made in accordance with the concepts of the present invention.

FIGS. 2 and 3 show an alternate embodiment or combination 25 of the lampshade of the present invention which includes an outer lampshade portion 10 similar to that discussed above with respect to FIG. 1 and an inner diffuser lampshade portion 28. The inner diffuser is similar in construction in that it includes an upper ring or hoop 30 and a lower ring or hoop 32 which are secured to one another by a suitable section of stretch knit fabric covering 34 as described above. The fabric 34 may be of a similar or dissimilar color and/or density as the covering 22. The support structure including a plurality of ribs 18 are used to provide a mounting for the outer lampshade 10 as described previously. However, in this embodiment, the central annular ring 38 is provided with a side slot 40 which is slightly larger than the conventional mounting post to facilitate horizontal sliding of the lampshade to remove it from the mounting structure.

Figure 4:
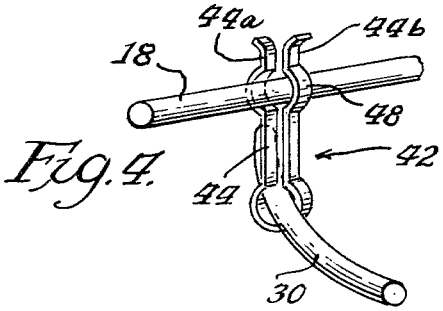
FIG. 4 is a perspective view of the attachment means between the diffuser and the lampshade.

The inner diffuser 28 is releasably or removably mounted to the main mounting structure by an attachment means generally designated 42 as shown in FIG. 4. Specifically, the upper hoop 30 is provided with a plurality of clips 44 as shown, one clip 44 is provided for each of the radial arms 18 and clips onto the arms 18. The two side elements 44*a* and 44*b* are biased together so that their flared ends permit a snap fit of an upper annular portion 48 over the arms 18 to mount the upper diffuser hoop 30 and thus the diffuser 28 generally in an axially aligned position relative to the outer flexible lampshade 10. In the embodiment shown in FIG. 33, the inner diffuser is substantially shorter than the outer lampshade 10 but is designed to enclose the entire area of the light source.

Figure 5:
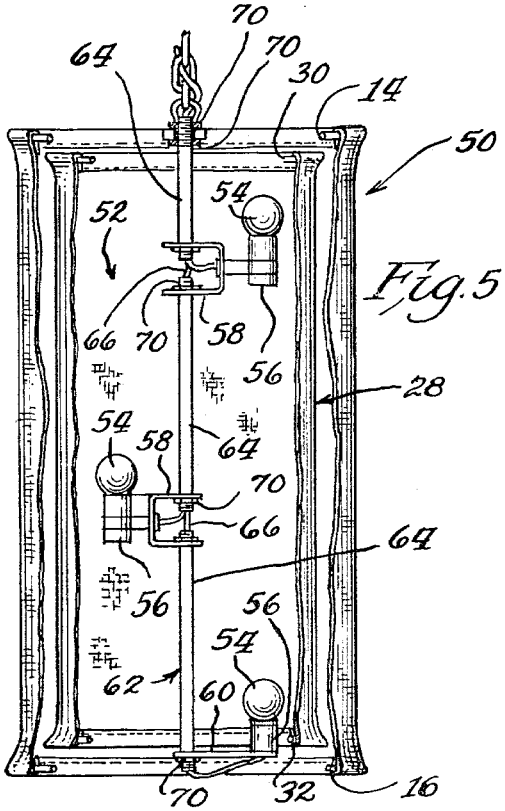
FIG. 5 is an alternate embodiment showing an elongated lampshade and diffuser in combination with a novel lighting fixture.

In another embodiment, as shown in FIG. 5, an elongated flexible lampshade, generally designated 50, is shown having an inner diffuser 28 of substantially similar length. The lampshade 50 is shown in combination with a novel lighting fixture 52 as described hereinafter. Specifically, the lighting fixture 52 includes a plurality of light sources 54 such as conventional lightbulbs and sockets 56. The sockets are mounted by either U-shaped brackets 58 or a simple longitudinal bracket 60 to a plurality of light source spacer means generally designated 62. The spacer means includes a plurality of generally tubular elements 64 which are conventionally used in the lighting industry to provide both support and a conduit for electrical connections such as 66. Each of the tubular elements 64 is threaded at its opposite ends so that a plurality of lock nuts 70 may be used to secure the brackets 58 and 60 to the spacer elements 64. In addition, a plurality of lock nuts 70 are used at the uppermost end of the upper spacer element 64 to secure the same to an annular mounting element of the configuration as shown in FIG. 2 having the slot 40 to facilitate slide or sideways type mounting. In a conventional manner, the lighting fixture 52 is secured to a chain for hanging the entire combination. The lighting fixture as shown in FIG. 5 can be substantially long such as four or five feet in length and provide an entire "wall wash" effect. In the embodiment shown in FIG. 5, the spacer elements 64 are increasingly longer moving downwardly along the axis, but can be of any shape and/or combination of shapes.

Figure 6:
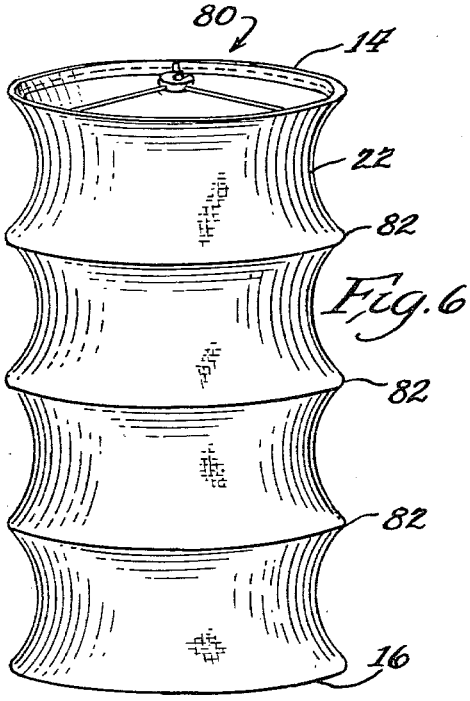
FIG. 6 shows a lampshade which is similar to the outer shape of FIG. 5 but includes a plurality of intermediate hoops.
Figure 7:
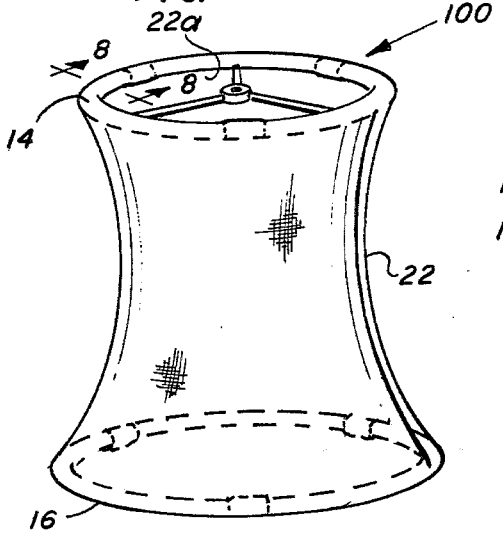
FIG. 7 is a perspective view of a lampshade made in accordance with the present invention utilizing manually operable quick release fastening means.

An alternate embodiment generally designated 80 is shown in FIG. 6 in which the upper ring 14 and lower ring 16 are secured within a generally tubular portion of covering 22. In this embodiment, a plurality of intermediate hoops or rings 82 provide an alternate shape or configuration of the lampshade. Note that the rings 14, 16 and 82 of this embodiment are all identical in diameter to provide the illustrated construction, however, various combinations and sizes of rings may be used in accordance with the concepts of the present invention in order to provide a multitude of shapes and shade designs without departing therefrom.

Alternative embodiments generally designated 100 shown in FIGS. 7–10 utilize a flexible covering 22 releasably secured to each of hoops 14 and 16 by three manually operable fastening means generally designated as 110. Such fastening means are commercially available under the designation or trademark "Velcro" and consist of preferably fabric strips covered on one side by "hooks" 111 and the other side by "loops" 112 which, in response to manual pressure releasably mesh and interconnect. Preferably the "loops" 112 are on the reverse side of the strip 110. The fastening means 110 and covering 22 may be selected to provide interlocking capability between "hooks" 111 and the inside of covering 22. However, attachment of covering 22 to hoops 14 and 16 is facilitated if fastening means 110 are joined by stitching 113 to terminal portions of covering 22.

Figure 8:
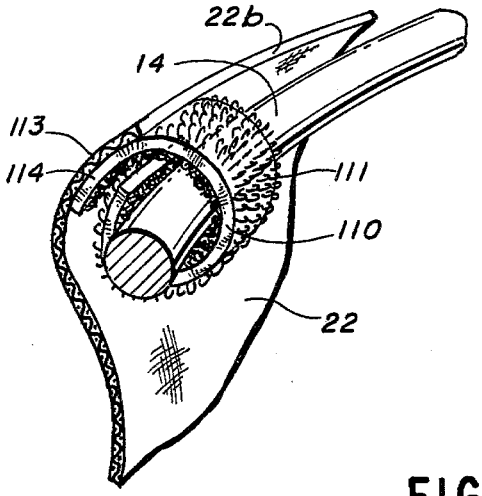
FIG. 8 is an enlarged partial sectional view taken generally along line 8—8 of FIG. 7 showing one mode of securing a first type of fastening means to the cover.
Figure 9:
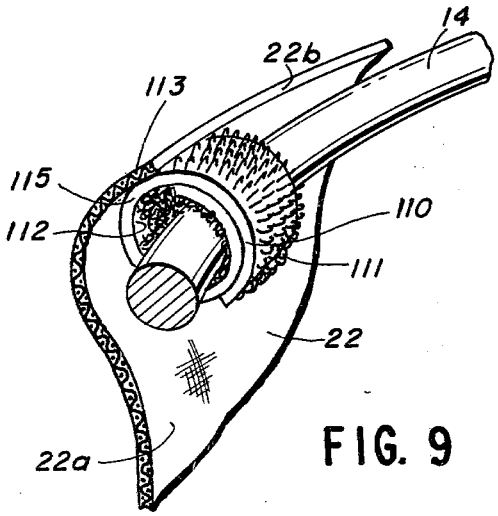
FIG. 9 is an enlarged partial sectional view similar to FIG. 8 showing a second mode of securing to the cover the same type of fastening as shown in FIG. 8.

As shown in FIGS. 8 and 9 the fastening means 110 are preferably relatively narrow strips of a length exceeding the circumference of associated hoops 14 and 16. As shown in FIG. 8 a terminal portion 114 of fastening means 110 may be stitched to covering 22, or as shown in FIG. 9 the center 115 may be stitched to covering 22 with "hooks" 111 facing the inside **22*a* of covering 22. The fastening means 110 wind or coil around the hoops 14 and 16 so that terminal portions of fastening means 112 overlap with their dissimilar surfaces facing each other to releasably mesh in response to manual pressure. To provide a finished appearance the edge 22*b* of covering 22 may be rotated toward the interior of the associated hoop 14 or 16, i.e., about one half of a revolution from the position shown in FIGS. 8 and 9**.

For such purposes as cleaning or replacing covering 22 hoops 14 and 16 are readily detached from the covering 22 by manually peeling the "hooks" 111 of fastening means 110 from the meshed "loops" 112. In this embodiment hoops 14 and 16 may be made of inexpensive corrosive metal or other material which might be adversely affected by exposure to cleaning agents.

Figure 10:
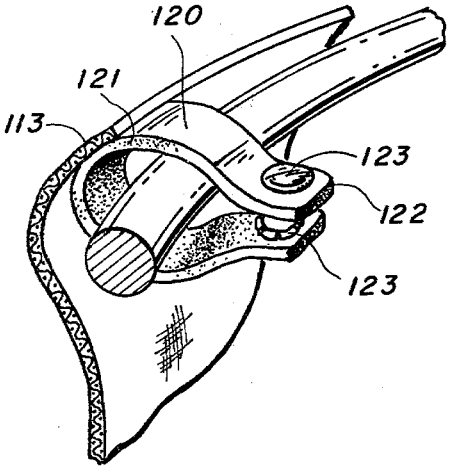
FIG. 10 is a sectional view corresponding generally to FIGS. 8 and 9 but illustrating a second type of fastening means.

FIG. 10 shows alternate fastening means in the form of a flexible clip generally designated as 120 preferably made of plastic or cloth or metal provided with a non-corrosive coating. Clip 120 is permanently attached to stitches 113 or other means to a terminal portion of covering 22.

Clip 120 has an intermediate channel-shaped portion 121 to envelop and generally conform to the cross-sectional configuration of hoops 14 and 16 which is shown as circular but could have various other shapes to secure clip 120 against orbital or rotational movement around hoops 14 and 16. Clip 120 has a pair of opposed arms 122 which are biased toward each other so that clip 120 may be snapped over hoops 14 and 16 secured thereon against orbital movement by pressure and friction. Such pressure and friction may be supplemented by providing on opposed faces of arms 122 mating interlocking means 123 which may be engaged by manual compression or rotation or other manipulation.

To obtain a finished appearance clips 120 on hoop 14 may be positioned with their arms extending inward and downward of hoop 14 and clips 120 on hoop 16 may be positioned with their arms extending inward and upward of hoop 16. For such purposes as cleaning or replacing covering 22 hoops 14 and 16 are readily detached from covering 22 by manually releasing interlock 123 where such is provided, and manually withdrawing clip 120 from engagement with hoop 14 or 16.

Figure 11:
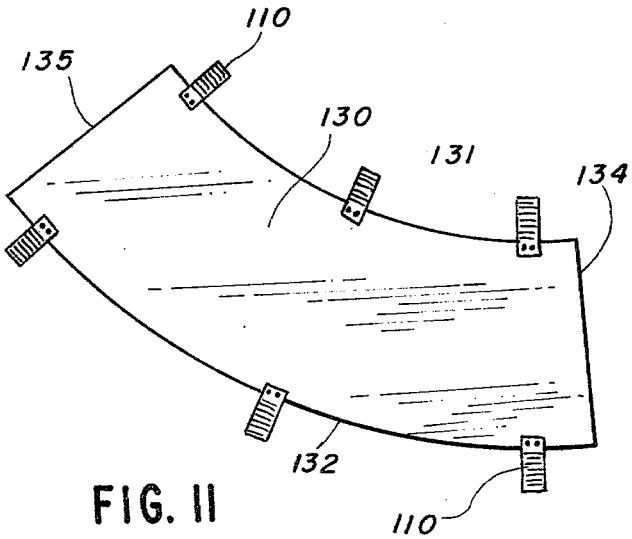
FIG. 11 is a top plan view of a planar-tropic covering in its unassembled condition for forming a frusto-conical lampshade.
Figure 12:
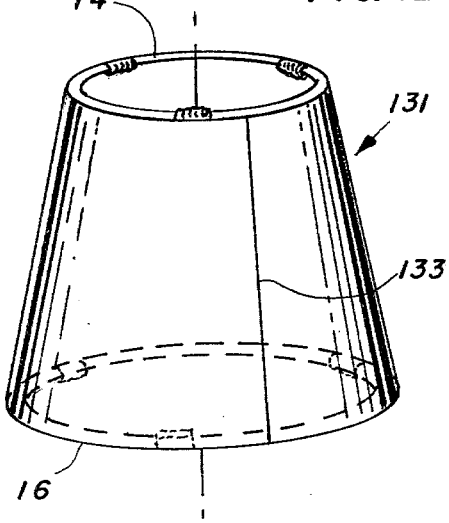
FIG. 12 is a perspective view of a lampshade assembly utilizing the covering shown in FIG. 11.

The alternate embodiment of the invention illustrated in FIGS. 11 and 12 utilizes a covering 130 of translucent inelastic plastic or paper or the like which will normally be planar but has sufficient flexibility to be manually bent around a pair of hoops 14 and 16. Covering 130 may be die-cut from larger sheets of material into patterns for frusto-conical lampshades 131 as illustrated in FIG. 12, or into rectangular patterns for cylindrical lampshades. Flexible fastening means 110 are attached to covering 130 at its top and bottom. Aligning edges of covering 130 with hoops of matching circumferences, i.e., edge 131 with hoop 14 and edge 132 with hoop 16, covering 130 is bent around the hoops and secured thereto by fastening means 110 in the manner described in conjunction with FIGS. 8 and 9. Seam 133 is preferably formed by butting edges 134 and 135. Lampshade 131 is readily disassembled by peeling apart meshed surfaces of fastening means 110 whereupon the covering 130 will tend to revert from its bent condition to a planar condition facilitating cleaning, storage and shipment thereof.

Furthermore, the above preferred and alternate embodiments have been given for clearness of understanding only and no unnecessary limitations should be understood therefrom as many modifications would be obvious to those skilled in the art.

I claim:

1. A collapsible lampshade comprising:

an upper hoop;

means secured to said upper hoop for supporting said lampshade on said lighting fixture;

a lower hoop;

a generally tubular stretched, elastic, flexible covering extending between said upper and lower hoop whereby the weight of the lower hoop maintains a form for the lampshade as generally equal stresses result therefrom over the surface of the flexible covering; and readily releasable fastening means for securing said covering to said hoops.

2. The collapsible lampshade of claim 1 wherein, said fastening means is secured to said covering and envelops segments of said hoop to secure said covering to said hoop.

3. The collapsible lampshade of claim 1 wherein, said fastening means is a flexible clip having a pair of arms resiliently biased toward each other for attachment to one of said hoops and having a portion intermediate said arms secured to said covering.

4. The collapsible lampshade of claim 3 wherein, said arms are provided with an interlock.

5. The collapsible lampshade of claim 4 wherein, said clip is provided with stabilizing means for maintaining its orbital position with respect to said hoop.

6. The collapsible lampshade of claim 1 wherein, said fastening means has two end portions and an intermediate portion and a first surface and a reverse surface opposite said first surface;

said first surface being adjacent to said covering and having adhering means suitable for adhering to said reverse surface.

7. The collapsible lampshade of claim 6 wherein, said intermediate portion of said fastening means is secured to said covering.

8. The collapsible lampshade of claim 6 wherein, one of said end portions of said fastening means is secured to said covering.

9. The collapsible lampshade of claim 7 or 8 wherein, portions of said fastening means coil around a segment of said hoop and portions of said fastening means overlap other portions thereof, thereby releasably securing said covering to said hoop.

10. A folding lampshade comprising:

a hoop;

means secured to said hoop for supporting said lampshade on a lighting fixture;

a pliable, planar-tropic light control sheet having an interior face and being capable of conforming to the circumferential base of said hoop; and fastening means attached to the interior face of said light control sheet for releasably securing said cover sheet to said hoop.

11. The collapsible lampshade of claim 10 wherein, said fastening means has two end portions and a first surface and a reverse surface opposite said first surface;

said first surface being adjacent to said covering;

means on said first surface for adhering to said reverse surface.

12. The collapsible lampshade of claim 11 wherein, one of said end portions of said fastening means is secured to said covering.

13. The collapsible lampshade of claim 11 wherein, portions of said fastening means coil around a segment of said hoop and portions of said fastening means overlap other portions thereof, thereby releasably securing said covering to said hoop.

* * * * *